US005907662A

United States Patent [19]

Buettner et al.

[11] Patent Number: 5,907,662

[45] Date of Patent: May 25, 1999

[54] ELECTRODE WELLS FOR POWERLINE-FREQUENCY ELECTRICAL HEATING OF SOILS

[75] Inventors: Harley M. Buettner; William D. Daily; Roger D. Aines; Robin L. Newmark, all of Livermore; Abelardo L. Ramirez, Pleasanton; William H. Siegel, Livermore, all of Calif.

[73] Assignee: Regents of the University of California, Oakland, Calif.

[21] Appl. No.: 08/794,219

[22] Filed: Jan. 30, 1997

[51] Int. Cl.[6] ..... E21B 7/15

[52] U.S. Cl. ..... 392/301; 392/302; 392/306; 166/248; 219/553; 422/32

[58] Field of Search ..... 392/301, 302, 392/305, 321, 306; 166/248, 280, 281, 295; 422/1, 22, 26, 32; 373/2, 8, 9; 219/553, 544

[56] References Cited

U.S. PATENT DOCUMENTS

| | | | |
|---|---|---|---|
| 2,799,641 | 7/1957 | Bell | 166/248 |
| 3,428,125 | 2/1969 | Parker | 166/248 |
| 3,642,066 | 2/1972 | Gill | 166/248 |
| 4,567,945 | 2/1986 | Segalman | 166/248 |
| 4,576,231 | 3/1986 | Dowling et al. | 166/248 |
| 4,951,748 | 8/1990 | Gill et al. | 166/248 |
| 5,120,935 | 6/1992 | Nenniger | 392/305 |
| 5,620,049 | 4/1997 | Gipson et al. | 166/248 |
| 5,656,239 | 8/1997 | Stegemeier et al. | 422/32 |

OTHER PUBLICATIONS

W. H. Siegel et al, "Dynamic Underground Stripping Engineering Demonstration Project: Construction, Operation and Engineering Results," Spectrum, 1992.

*Primary Examiner*—Tu Ba Hoang
*Attorney, Agent, or Firm*—L.E. Carnahan

[57] ABSTRACT

An electrode well for use in powerline-frequency heating of soils for decontamination of the soil. Heating of soils enables the removal of volatile organic compounds from soil when utilized in combination with vacuum extraction. A preferred embodiment of the electrode well utilizes a mild steel pipe as the current-carrying conductor to at least one stainless steel electrode surrounded by a conductive backfill material, preferably graphite or steel shot. A covering is also provided for electrically insulating the current-carrying pipe. One of the electrode wells is utilized with an extraction well which is under subatmospheric pressure to withdraw the volatile material, such as gasoline and trichioroethylene (TCE) as it is heated.

24 Claims, 2 Drawing Sheets

ELECTRODE WELLS FOR POWERLINE-FREQUENCY ELECTRICAL HEATING OF SOILS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to soil decontamination, particularly to the use of electrical heating technology for removing volatile organic compounds from soils, and more particularly to electrode well for powerline-frequency electrical heating of soils used in combination with vacuum extraction to remove organic compounds from contaminated soils.

Cleanup of soil contamination by volatile organic compounds, either on the ground surface or subsurface, such as gasoline and trichloroethylene (TCE) has become a major concern, especially where the contaminated areas are located adjacent to underground water. Various prior approaches have been utilized to eliminate the soil contamination, often caused by leakage of fuel or oil tanks, industrial wastes, fuel or oil spills, etc. The primary prior approach to remove contamination from the soil has been excavation to physically remove the contaminated soil. However, the removed soil remains contaminated thus posing a storage problem, as well as the costs of removal and hauling. Also, excavation can only be carried to a certain depth, leaving contamination beyond that depth. Thus, there has been a need for cost effective, rapid cleanup of localized underground contamination.

The present invention provides a partial solution to surface or underground soil decontamination, particularly where the contamination is located less than about fifty feet beneath the ground surface. The invention involves one or more electrode wells for powerline-frequency electrical heating of the contaminated soil in combination with an extraction well or wells under subatmospheric conditions. Heating of the soil by the electrode wells enables the volatile organic compounds, such as gasoline and TCE, to be withdrawn via the extraction well for treatment, storage, and disposal above the ground surface. The electrode wells and the extraction well may be located in small holes drilled by augers or small drill rigs, thus reducing the costs of insertion of the wells. The electrode wells utilize one or more electrodes surrounded by a conductive backfill material, such as damp sand, steel shot, or graphite to increase conductance into the soil formation. A preferred embodiment utilizes mild steel pipe as the current-carrying conductor.

SUMMARY OF THE INVENTION

It is an object of the present invention to remove volatile organic compounds from soil.

A further object of the invention is to provide electrode wells for heating the soil for decontamination thereof.

A further object of the invention is to provide electrode wells for powerline-frequency electrical heating of soils.

Another object of the invention is to provide electrode wells for decontamination by electrical heating of the soils in conjunction with a subatmospheric pressure extraction well.

Another object of the invention is to provide an electrode well for electrical heating of contaminated soil utilizing a mild steel pipe as the current-carrying conductor and at least one electrode surrounded by a conductive backfill material.

Another object of the invention is to provide electrode wells for powerline-frequency electrical heating of contaminated soils utilizing an insulated hollow pipe as the current-carrying conductor and one or more stainless steel electrodes surrounded by a conductive material to provide electrical conductance into the soil formation.

Other objects and advantages of the present invention will become apparent from the following description and accompanying drawings. The invention involves decontamination of soil by volatile organic compounds and specifically electrode wells for powerline-frequency electrical heating of soils used in conjunction with vacuum extraction. A preferred embodiment of the electrode wells utilizes an insulated mild steel pipe as the current-carrying conductor to one or more stainless steel electrodes surrounded by a conductive material, such as damp sand, steel shot, graphite, etc., which provides conductance from the one or more electrodes to the surrounding soil formation. The electrode wells may be used for decontamination of surface and near surface soil as well as subsurface (underground) contaminated areas without excavation and or large drill apparatus for installation. Tests of the electrode wells have been conducted in conjunction with an extraction well operating under subatmospheric pressure conditions, with the wells having a diameter of 4 to 8 inches, extending about twenty (20) feet under the surface of the ground, and equally spaced on a 20 foot diameter circle. These tests established that a hollow pipe provides a better current-carrying conductor and that steel shot or graphite material around the electrodes provided increased conductance over damp sand and also eliminated the need to maintain the sand in a dampened condition during heating of the surrounding soil.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The present invention is directed to electrode wells for powerline-frequency electrical heating of soils for removing volatile organic compounds from the soil. Volatile organic compounds such as oil, gasoline, and trichloroethylene (TCE) are common soil contaminates and must be removed to protect underground water. It has been found that by utilizing specialized electrode well designs, powerline-frequency electrical heating of contaminated soils in conjunction with vacuum extraction can be a cost-effective method for rapid cleanup of localized contaminated soil. It is acknowledged that powerline-frequency electrical heating of an area surrounding a wellbore and between wellbores has been used in the oil industry to enhance the extraction of heavy oils. However, no known prior efforts have utilized powerline-frequency electrical heating of soils for the removal of volatile organic compounds. Powerline-frequency (60 Hz) electrical heating is conceptually very simple. When electric currents flow through soil, the power dissipated through ohmic losses heats the soil. This process is analogous to the operation of the heating element in a simple home space heater or an electric range. In practice, voltages in the range of a few hundred volts are applied to arrays of electrodes embedded in the soil, and the impressed voltages cause current flow and the resultant ohmic heating. The required power is readily available from the commercial power grid or motor-generators.

Figure 1:
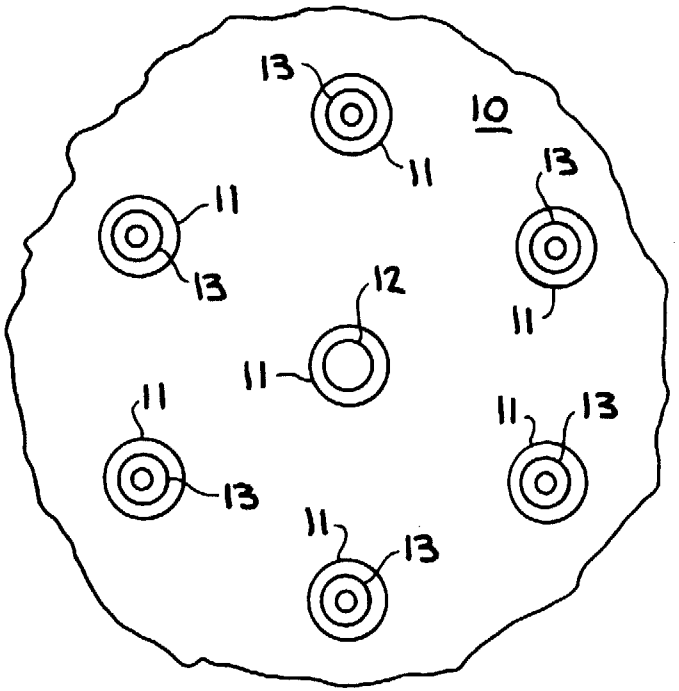
FIG. 1 schematically illustrates a plan view of a typical contamination site or area utilizing a single extraction well and a plurality of electrode wells made in accordance with the present invention.

Referring now to the drawings, FIG. 1 illustrates a typical electrode well pattern for decontamination of soil containing volatile organic compounds. The contamination area 10 is provided with seven (7) holes 11 into which a central extraction well 12 and six (6) electrode or heating wells 13 are located. The holes 11 may be made by auger or by a small drill rig, depending on the depth of the holes and the composition of the soil. In the initial experimental test pattern described in greater detail hereinafter the holes 11 were a maximum of 20 feet deep with a diameter of 4 to 8 inches. The six heating wells 13 were equally spaced on a 20 foot diameter circle, with the extraction well 12 located centrally in the circle, as illustrated in FIG. 1. The initial verification (test) experiments utilized the electrode or heating well embodiments illustrated in FIGS. 3 and 4. In view of the results of these initial tests, the structure of the electrode well has been modified as illustrated by the preferred embodiment of FIG. 2.

Figure 2:
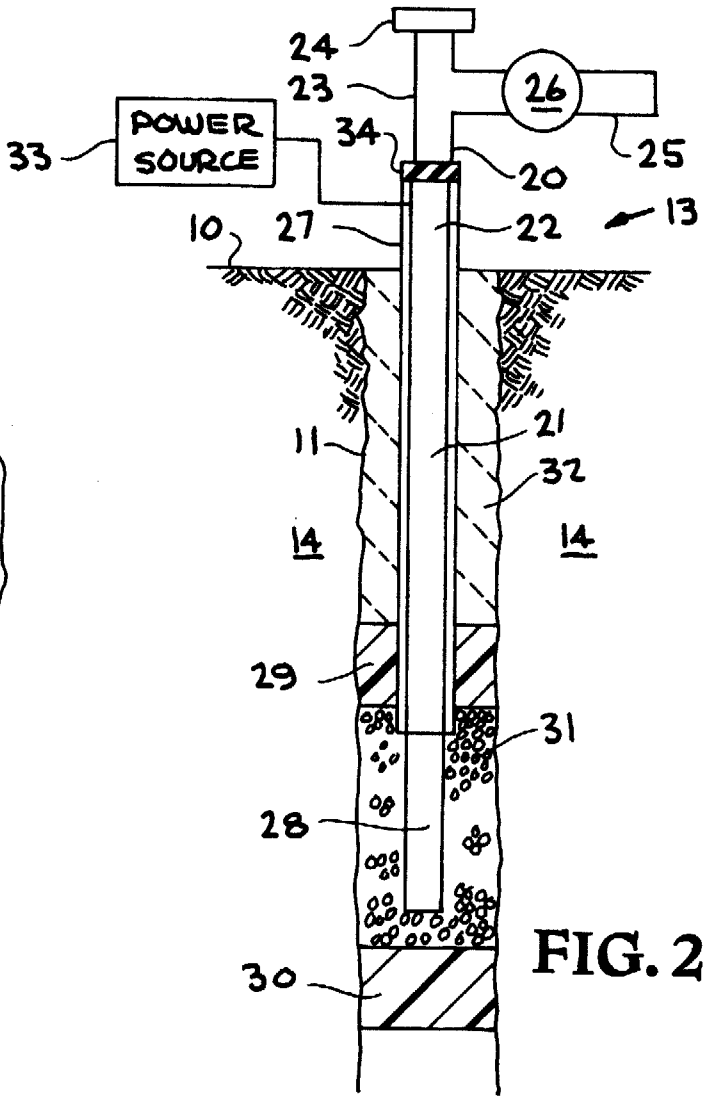
FIG. 2 is a partial cross-sectional view of a preferred embodiment of the electrode well made according to the invention.

The preferred embodiment of the electrode or heating well 13 of FIG. 2 is shown located in a hole 11 which has been augured or drilled in soil 14 of the contamination area 10. The heating or electrode well 13 includes a mild steel pipe 20 having a section 21 extending into hole 11 and a section 22 extending above the ground surface and including a "T" section 23 with a removable cap 24 and connected to a mild steel pipe section 25 via a valve 26. The section 21 of pipe 20 extending into hole 11 and part of the section 22 above ground includes an insulating covering 27 which keeps the current confined to the area of the soil 14 adjacent an electrode 28 and which may be, for example, a 0.030 inch thick Teflon sheet wrapped around pipe 20 and secured with PVC tape. The electrode 28, hollow stainless steel screen electrode, is secured, as by welding or threads, to the lower end of pipe section 21. A pair of Bentonite (montmorillonite clay) plugs 29 and 30 are positioned above and below the electrode 28 to hydraulically isolate the electrode region from the rest of the wellbore, and a conductive material or packing 31 forms a backfill in hole 11 around electrode 28 and plugs 29 and 30 to keep the contact resistance between the electrode and said soil at a low value. The conductive backfill material or electrode packing may be composed of wetted or damp sand, steel shot, or anode graphite, preferably steel shot or graphite which provides increased conductance between the electrode 28 and the soil 14. After installing the plug 30, conductive backfill material 31 and plug 29, the remaining portion of hole 11 into which pipe section 21 extends is filled with grout 32, which may be composed of API Class G Grout and functions to keep the insulation 27 in place and provides an impermeable barrier between the electrode 28 and the ground.

The mild steel pipe 20 functions as a current-carrying conductor from a power source 33 to electrode 28 and serves to carry cooling water to the electrode 28 via pipe section 25 and valve 26, and water the conductive backfill 31, particularly when sand is utilized. To prevent electrical current from flowing to "T" section 23, an electrical insulator 34 is positioned between pipe section 22 and "T" section 23. The removable cap 24 provides access to pipe 20 for maintenance of down-hole components or for addition of diagnostic sensors or instrumentation (not shown). The hollow electrode 28 is formed as a screen to allow for cooling by water via valve 26 and pipe 20, which water passes to the surrounding conductive backfill material 31, which is essential where the material 31 is sand which must be maintained in a dampened condition, and which dries out due to heating of surrounding soil 14 by the electrode 28. The insulative covering 27 of pipe 20 must be capable of withstanding temperatures around 200° C. without deterioration in its electrical resistivity. While the pipe 20 and insulation 27 may be formed of commercial insulated steel pipe, such is very expensive.

By way of example, the hole 11 has a diameter of 12 inches, the Schedule 40 mild steel pipe 20 ranges in diameter from 1–6 inches with an overall length, excluding "T" section 23 of 20–120 feet, and could be constructed of black steel pipe. The hollow electrode 28 constructed of stainless steel could be constructed of wire wrapped or slotted well screen, has an external diameter of 1–6 inches with slotted section forming the screen having openings of 0.005 to 0.020. The conductive material 31 may be composed of steel shot having a diameter of 0.040 to 0.120 inch, or anode graphite pieces or powder. The power supply 33 is at powerline-frequency (voltage of 208 to 600 VAC) and provides an electrical current through the pipe 20 of 50 to 500 Amps. The amount of current flow through the pipe 20 is determined by the voltage applied between any two electrodes (or any two groups of electrodes) and the electrical resistance between the same two electrodes (or groups of electrodes), and is given by the ratio of the voltage to the resistance.

Figure 3:
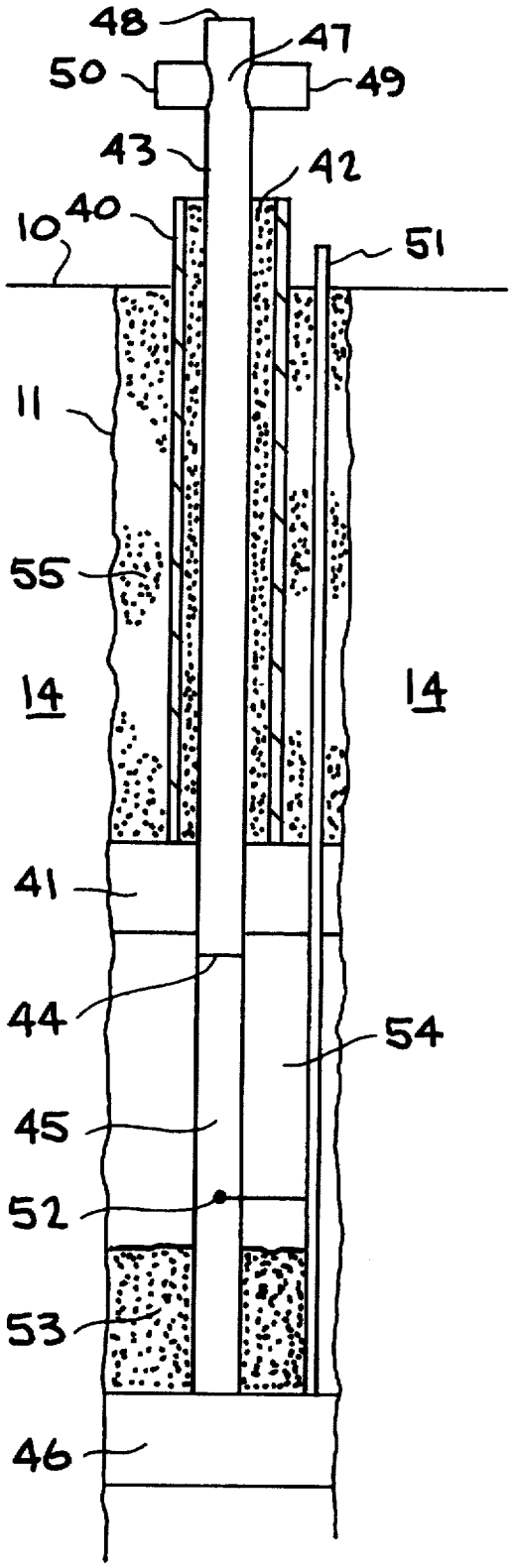
FIG. 3 illustrates another embodiment of an electrode well utilizing a hollow conductive pipe as in the preferred embodiment but with a different electrode arrangement.
Figure 4:
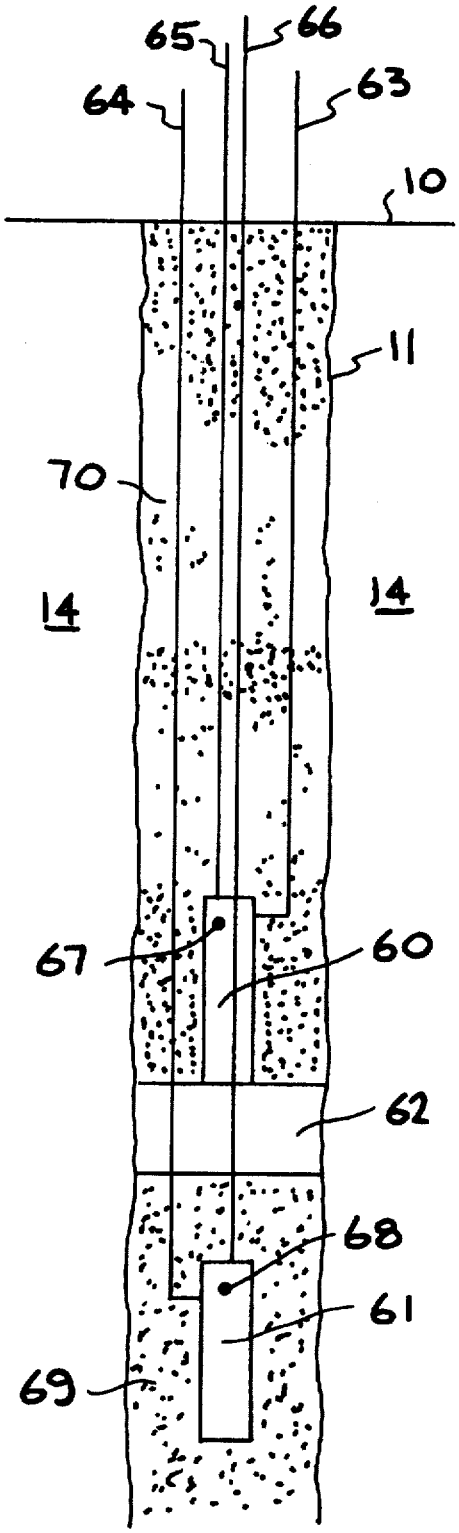
FIG. 4 illustrates another embodiment of an electrode well without the hollow conductive pipe and using a separated electrode arrangement.

FIGS. 3 and 4 illustrate embodiments of electrode or heating wells utilized in the verification. The FIG. 3 embodiment was designed to improve features and functional characteristics uncovered during the initial verification tests utilizing the FIG. 4 embodiment, and as the result of tests conducted using the FIG. 3 embodiment, the electrode or heating well was modified as described above in FIG. 2, the preferred embodiment.

FIG. 3 which illustrates improvements over the embodiment of the FIG. 4 electrode or heating well, is located in a hole 11 in soil 14 of a contaminated area 10, and comprises a hollow pipe 40 which extends into hole 11 and abuts against a Bentonite plug 41. A pipe 43 extends downwardly through pipe 40 and through plug 41 and is secured, as by welding, at joint 44 to a stainless steel slotted screen electrode 45 which extends downward and abuts against a second Bentonite plug 46 located at the bottom of hole 11. A space 42 between pipes 40 and 43 is filled with #3 sand. Pipe 43 is provided at the upper end with a "T" coupling 47 having a removable plug 48, a pressure gauge 49, and an electrode water supply port 50. A fiberglass tubing 51 extends from above the ground surface, through Bentonite plug 41, and abuts against Bentonite plug 46. A thermocouple 52 is secured to electrode 45 and the lead wires therefore extend upwardly and are attached to the outer surface of tubing 51. The lower end of electrode 45 (about 3 feet) contains gravel stemming indicated at 53. A space 54 of hole 11 (distance of about 9 feet) between the Bentonite plugs 41 and 46 is filled with a packing of conductive material such as #3 sand, anode graphite grade stemming, or steel shot stemming. A space 55 of hole 11 (distance of 9 feet) between the Bentonite plug 41 and the ground surface is filled with #3 sand. Electrical current is carried to screen electrode 45 by pipe 43 and is supplied by a powerline-frequency (60 Hz) system located on the surface. Pipe 43 may include an insulator layer around the external surface as in the FIG. 2 embodiment. The source of power may be the commercial power grid or an appropriate motor-generator. Appropriate transformers, cabling, and control circuits are also used to provide suitable voltages to the electrodes.

By way of example, hole 11 is 20 feet deep with a diameter of 8 inches, with hollow pipe 40 being constructed of Schedule 40 PVC pipe having an external diameter of 4 inches. Pipe 43 is constructed of Schedule 40 black steel pipe having a 1.5 inch external diameter, and length of 11 feet, with slotted screen electrode 45 having a length of 9 feet, external diameter of 1.5 inches with 0.020 inch slots to provide 5% open space. The fiberglass tubing 51 has, for example, an internal diameter of 0.25 inch and with attached thermocouple having a length of 20 feet. Removal plug 48 enables insertion of diagnostic sensors or instrumentation into screen electrode 45 while water is supplied via port 50 to screened electrode 45 and to the surrounding backfill material in space 54 to maintain good conductance with the soil 14 around hole 11, as described above. A voltage of 240 to 480 VAC and current of 50 to 200 Amps is produced by an associated power supply, not shown in FIG. 3, to cause heating of soil 14 via electrode 45.

The FIG. 4 embodiment of the electrode or heating well differs from the FIGS. 3 and 2 embodiments by utilizing a pair of electrode areas separated by a Bentonite plug, and using sand only as the conductive material between the electrodes and the soil, the pair of electrodes having an overall length similar to the single electrode of the FIG. 3 embodiment. The electrode well of FIG. 4 is located in an auger hole 11 in soil 14 of contaminated area 10, with the hole 11 having a depth of 20 feet and diameter of six inches. This embodiment comprises a pair of stainless steel slotted screen electrodes 60 and 61 between which is located a Bentonite plug 62, with upper electrode 60 abutting plug 62 and lower electrode 61 spaced from plug 62. A pair of Teflon jacketed wires 63 and 64 extend from above to ground downwardly in hole 11 with wire 63 connected to upper electrode 60 and wire 64 extending through plug 62 and connected to lower electrode 61. A pair of 0.375 inch diameter water supply tubes 65 and 66 extend from above the ground downwardly in hole 11, with tube 65 terminating at the upper end of upper electrode 60 and with tube 66 extending through electrode 60, through Bentonite plug 62 and terminals at the upper end of lower electrode 61. A pair of thermocouples 67 and 68 are secured to the upper ends of electrodes 60 and 61 respectively, with lead wires, not shown, extending up hole 11 to the ground surface for connection to instrumentation. A space 69 of hole 11 between plug 62 and the bottom of the hole 11 and around electrode 61 is filled with #3 sand, and a space 70 of hole 11 between the plug 62 and the ground surface is also filled with #3 sand. Thus, the sand in space 69 forms an electrode packing. The sand adjacent the electrodes 60 and 61 is maintained damp via water supplied through tubes 65 and 66 which passes outwardly through the slots in the electrodes into the adjacent sand which constitutes a conductivity path from the electrodes to the soil 14, as described above.

By way of example, each of the electrodes 60 and 61 have a length of 4 feet and a diameter of 4 inches, the Bentonite plug 62 has a thickness of one foot with space 69 having a length of five feet and space 70 having a length of ten feet. Current is supplied to the electrodes 60 and 61 via wires 63 and 64 from a powerline-frequency source not shown.

Electrical heating tests were conducted using a six electrode well pattern as shown in FIG. 1, primarily to evaluate the effects of moisture content and completion materials around each electrode well, as well as electrode power density. It was found that conductance into the soil formation was greatly affected by moisture content around the electrode. Amperage levels were high when the soil was moist and gradually dropped as the area around the electrode heated and dried. Amperage levels were controlled somewhat by selectively wetting electrodes with lower current values. However, better control was achieved by regulating generator output voltage.

The first heating experiment (Test 1) was conducted using a pattern of electrode or heating wells illustrated in FIG. 4 with a three-phase, 72 kW generator operated at 480 volts. The test was conducted for 15 days (11 days running 24 hours/day and 4 days running 12 hours/day). Sand completion (conduction) material was used around all the electrodes.

During the two-week test (Test 1), the temperature in the center of the 20 foot diameter pattern increased from 19° C. to 38° C. (1.6° C./d) during the 24 hour/day heating and finally to 44° C. during the 12 hour/day heating period. During the test the electrode packing or conductive material composed of sand had to be wet continuously from water reservoirs at the surface to maintain conductivity into the soil. The average current per phase was 73 Amps during a 24 hour/day heating.

The second heating experiment (Test 2) was conducted in the same pattern but utilizing an electrode or heating well of the FIG. 3 embodiment, and was operated at 240 volts. Test 2 ran 12 hour/day for 44 days. Steel shot or anode grade graphite was used in place of the sand completion (conduction) material around four of the six electrodes. Amperage levels for the electrodes in the steel shot and graphite wells remained consistently higher than in the two wells completed with sand. The average current per phase varied from 44 Amp for phases with electrodes packed in sand, to 60 Amp for phases with electrodes packed only in steel shot or graphite. To maintain conductivity into the formation, electrodes packed with graphite or steel shot required minimal wetting, at most only once per day.

During Test 2, the temperature at the center of the pattern increased from 40° C. to 54° C.; the rate of temperature change was 0.54° C./d. The lower heating rate of this test (compared with Test 1) reflects the applied voltage of 240 volts versus 480 volts and heating for 12 hour/day instead of 24 hour/day.

Test 3 utilized the electrode or heating well embodiment of FIG. 3 with sand and steel shot or graphite completion material and used a three-phase, 100 kW generator with an applied voltage of 480 volts. However, only three of the six wells were used. The test was conducted for 12 hour/day for five days. The temperature at the center of the pattern increased a total of 12° C.; the average daily heating rate was 1.25° C. The average current per phase during Test 3 varied from 135 Amp for phases with electrodes packed in sand to 139 Amp for phases with electrodes packed only in steel shot or graphite.

It was found from the three above-described tests that generally electrodes packed in steel shot or graphite maintained higher amperage levels with less frequent wetting requirements than electrodes packed in sand. From an operating standpoint, Tests 2 and 3 required much less maintenance and monitoring.

It has thus been shown that the present invention provides electrode wells for powerline-frequency electrical heating of soils, particularly adapted for removal of volatile organic compounds from soil by means of soil heating along with vacuum extraction. The preferred embodiment utilizes mild steel pipe as the current-carrying conductor to a stainless steel electrode packed in conductive backfill material, preferably steel shot or graphite.

While particular embodiments, materials, parameters, etc., have been set forth to exemplify and teach the principles of the invention, such are not intended to be limiting. Modifications and changes may become apparent to those skilled in the art, and it is intended that the invention be limited only by the scope of the appended claims.

The invention claimed is:

1. An electrode well for powerline-frequency electrical heating of soils, comprising:

at least one electrode adapted to be positioned in a hole in contaminated soil, means for supplying 60 HZ powerline-frequency electrical current to said at least one electrode, means for supplying coolant to said at least one electrode, and conductive material surrounding a tip of said at least one electrode, whereby heating said at least one electrode by electrical current causes heating of contaminated soil located around said electrode.

2. The electrode well of claim 1, wherein said at least one electrode is constructed of a screen material to allow coolant to pass therethrough.

3. The electrode well of claim 1, wherein said means for supplying electrical current to said at least one electrode including a hollow member.

4. The electrode well of claim 3, wherein said hollow member has a layer of insulation around at least a section of an outer surface of such hollow member.

5. The electrode well of claim 3, wherein said hollow member is constructed of mild steel and functions as a current-carrying conductor.

6. The electrode well of claim 3, wherein an end of said hollow member is secured to an end of said at least one electrode.

7. The electrode well of claim 1, additionally including at least one montmorillonite clay plug positioned adjacent one end of said at least one electrode.

8. The electrode well of claim 1, additionally including a pair of montmorillonite clay plugs located at opposite ends of said at least one electrode.

9. The electrode well of claim 1, wherein said at least one electrode abuts one of said pair of montmorillonite clay plugs and is located adjacent another of said pair of montmorillonite clay plugs.

10. The electrode well of claim 1, additionally including a second electrode spaced in alignment with said at least one electrode, and wherein said current supplying means and said coolant supply means are connected to each of said electrodes.

11. The electrode well of claim 10, additionally including a montmorillonite clay plug located intermediate said electrodes, and wherein said conductive material is composed of sand.

12. The electrode well of claim 1, wherein said conductive material is selected from the group consisting of sand, steel shot, and graphite.

13. The electrode well of claim 1, wherein said at least one electrode comprises a hollow screen stainless steel electrode.

14. The electrode well of claim 13, wherein said means for supplying electrical current includes a mild steel pipe connected to one end of said electrode and functions as a current-carrying conductor to said electrode, said steel pipe having a layer of insulation around at least a section of said steel pipe.

15. The electrode well of claim 14, additionally including a pair of montmorillonite clay plugs, one of said pair of plugs being located in spaced relation to said electrode, another of said pair of plugs being spaced from said electrode and extending around said pipe.

16. The electrode well of claim 15, wherein said conductive material is located intermediate said pair of montmorillonite clay plugs.

17. The electrode well of claim 16, wherein said pipe is provided with a "T" coupler at one end, and wherein said "T" coupler is connected to and constitutes part of said means for supplying coolant to said electrode.

18. The electrode well of claim 17, additionally including grout located around said pipe and above said another of said pair of plugs.

19. In a system for removing volatile organic material from soil, at least one electrode well positioned in a hole in the soil for powerline-frequency electrical heating of the soil, said electrode well comprising:

a montmorillonite clay plug, a hollow screen stainless steel electrode located in spaced relation to said montmorillonite clay plug, a mild steel pipe connected to said electrode, a second montmorillonite clay plug positioned around said pipe, conductive material located intermediate said montmorillonite clay plugs, grout surrounding said pipe and located above said second montmorillonite clay plug, a 60 Hz powerline-frequency electrical power supply connected to said pipe, said pipe being a current-carrying conductor to said electrode, and means connected to said pipe for supplying coolant to at least said electrode for cooling said conductive material.

20. The electrode well of claim 19, wherein said conductive material is selected from the group consisting of damp sand, steel shot, and graphite.

21. The electrode well of claim 20, wherein said means connected to said pipe for supplying coolant includes a coupler having a removal cap and a section connected to a valve for controlling coolant supplied to at least said electrode.

22. The electrode well of claim 19, additionally including an insulator around said pipe.

23. The electrode well of claim 1, additionally including a thermocouple operatively connected to said at least one electrode.

24. In the system of claim 19 additionally including a plurality of electrode wells and a vacuum extraction well, said electrode wells being spaced from said extraction well and from one another, whereby volatile organic material is heated by said electrode wells and extracted via said vacuum extraction well.

* * * * *